United States Patent [19]

Mercier et al.

[11] 4,441,396

[45] Apr. 10, 1984

[54] SLITTING MACHINE, MORE PARTICULARLY FOR HIDES AND LEATHER, UNWOVEN TEXTILE PRODUCTS, RUBBER PRODUCTS, PLASTICS IN PLATES OR ROLLS

[75] Inventors: Georges Mercier, Annonay; Jacques Mercier, Andrezieux; Pierre Buisson, Annonay, all of France

[73] Assignee: Societe MERCIER Freres, France

[21] Appl. No.: 296,001

[22] Filed: Aug. 25, 1981

[30] Foreign Application Priority Data

Sep. 3, 1980 [FR] France ..... 80 19375
Jul. 20, 1981 [FR] France ..... 81 14588

[51] Int. Cl.[3] ..... C14B 1/18

[52] U.S. Cl. ..... 83/871; 83/174; 83/809; 83/813; 69/10

[58] Field of Search ..... 83/871, 874, 174, 809, 83/813; 69/10

[56] References Cited

U.S. PATENT DOCUMENTS

Re. 27,248 12/1971 Mercier ..... 69/10
1,759,507 5/1930 Hawkinson ..... 83/871
2,524,016 9/1950 Hall ..... 83/874

FOREIGN PATENT DOCUMENTS 1398484 3/1965 France ..... 69/10

*Primary Examiner*—James M. Meister
*Attorney, Agent, or Firm*—Eric P. Schellin

[57] ABSTRACT

An apparatus utilizing an endless blade for splitting hides, textile products and the like. A fixed assembly carries upper and lower cylinders or rollers for feeding the workpiece to the blade. A mobile or movable assembly carries the blade mounted on two spaced pulleys and is adjustable with respect to the rollers in order to change the spacing between the blade edge and the feeding plane between the rollers. Also mounted on the movable assembly is a sharpening device in the form of two grinding wheels which are biased toward the blade edge. A blade positioning mechanism controlled by a photocell sensing the position of the blade edge maintains the blade edge in the desired position relative to the rollers despite erosion of the blade due to sharpening and wear.

17 Claims, 20 Drawing Figures

21
23d
13
22d
35
34
36b
26
25
36a
38
37
42
14
4d
1d
3d
12d
11d
27
2
4
6
27a
15
10
3g
11g
1g
4g
12g
12h
22g
14g
9
5
66
23g
65
33
65a
65b
20

24
13
23d
22d
25
21
34
36b
36a
37
42
1d
18d
3d
2
4
10
1g
18g
3g
22g
23g
33

30d
67d
70
67c
67a
68
71
69
30a
30
28
28
13
31
29
67g
30g
32
33

23d
24
22d
21
29
28b
30d
25
1d
18d
25a
31
30
28c
F
28c
13
28
18g
28a
1g
30g
23g
22g
32
33

SLITTING MACHINE, MORE PARTICULARLY FOR HIDES AND LEATHER, UNWOVEN TEXTILE PRODUCTS, RUBBER PRODUCTS, PLASTICS IN PLATES OR ROLLS

The invention relates to a slitting machine, more particularly for hides and leather, unwoven textile products, rubber products, plastics in plates or rolls.

Machines for carrying out the slitting process are known; this process consists in separating in one or more layers, in their thickness, the materials or products to be treated. These machines include mainly a framework, a working plane or table on which the materials or products to be slit are presented in a flat position, a driving device for said products or materials ahead the cutting line, by means of two cylinders, one of which is located above the plane of the tensioned side of a flexible endless cutting blade mounted on two pulleys one of which at least is motive and tensioning, said upper cylinder being positioned relative to the plane of the tensioned side of the blade in an adjustable manner in accordance with the slitting thickness desired. The second cylinder is located beneath the plane of the tensioned side of the blade, and consists generally of independent cylindrical elements or rings which are in alignment by abutment against a metal guide, and being moreover supported and driven by a rotatably driven cylinder with peripheral lining of rubber. The purpose of the cylinder with parts, consisting of separate rings but which are mounted together, is to apply on the products to be slit a pressure remaining steady for any variations in the thickness of the materials or products to be slit. Moreover, besides various adjustment means, the slitting machines are usually equipped with a sharpening means for the endless blade, constituted by two grinding wheels each one of which is working on one of the two bevelled faces forming at their intersection the cutting edge of the blade.

With the exception of some adjustments, the elements of these machines are mounted fixedly to one another.

Such machines have an important disadvantage in that the slitting conditions of the various materials or products: slitting thickness, density, structure . . . necessitate some modifications of position between the edge of the cutting blade and the driving plane, i.e. at the imaginary plane passing through the axes of the driving and element cylinders. These modifications of position of the edge of the cutting blade are effected by the shifting of said blade relative to the parts for supporting, guiding and driving this blade and which control the position thereof while ensuring the sharpening. It is necessary then to perform a plurality of compensating adjustments in order to find for a novel position of the cutting edge a convenient position of the sharpening wheels, and such a handling is time consuming, delicate and empirical.

A further disadvantage of the known machines resides in the fact that is difficult for the operator to maintain steadily and regardless of the permanent adjustments the position of the cutting edge at a suitable level in regard to the thickness of the blade. This is understandable when it is considered that one of the bevelled faces is formed on the upper part, along an edge portion of the blade, by a first sharpening wheel. The other bevelled face is formed by a second sharpening wheel, on the lower part, along the same edge portion of the blade.

The sharpening actions of both grinding wheels must be accurately rated in order to give to the blade the cutting quality required and to maintain substantially constant the widths of the faces of the two bevels, and consequently in order to maintain constant the position of the cutting edge with respect to the thickness of the blade. These sharpening actions are left to the initiative of the operator, who has no accurate valuation means available, so that the chances of misadjustment are not to be avoided.

The object of the present invention is to eliminate these disadvantages.

In accordance with a first characteristic of the machine, the supporting structure thereof is designed to separate the parts of said machine in two distinctive assemblies, and namely:

a fixed assembly with devices for presenting, positioning and driving the products, said devices being located on either side of the cutting line and adjustable distinctly and separately with respect to this cutting line constituted by the cutting edge of the upper tensioned side of an endless blade;

a mobile assembly within the horizontal plane relative to the fixed assembly, comprising a blade carrying frame equipped with all the parts for guiding, positioning, driving and sharpening this blade, the cutting edge of which is formed at the intersection of two sharpened bevelled faces and has an immutable position within the horizontal plane, with respect to the frame, said mobile assembly being movable relative to the fixed assembly of the structure to modify the spacing between the driving plane which is the imaginary plane passing through the axes of the driving cylinder and cylinder with elements supported by the fixed assembly and the cutting edge of the blade positioned in an immutable manner within the horizontal plane relative to the mobile assembly.

In accordance with a further characteristic, the fixed assembly resting on the ground includes two vertical supporting frameworks which are braced for the parallelism, the stiffness and the stability thereof, said vertical supports carrying two guides which are parallel and on which are placed the upper bridge and the lower abutment part for the presentation of the materials or products in front of the cutting blade and the driving of said materials or products at the desired speed; the lower abutment part, which carries the cylinder with rings or cylinder with elements, includes all the parts which are necessary for positioning said cylinder, for guiding same, for holding and abutting same by virtue of the presence of a cylinder with a rubber coating of a pre-determined hardening; the upper bridge carries the driving cylinder, and includes all the elements which are necessary for positioning said cylinder, for guiding and abutting same, the upper bridge and the lower abutment part being positioned on either side above and beneath the tensioned upper side of the cutting blade in dependence on the characteristics of the slitting to be made, all this being obtained by handling procedures in connection with the two parallel guides which are integral with the frameworks.

In accordance with a further characteristic, the positionally adjustable mobile assembly has mounted on a longitudinal frame the supporting and driving parts for the cutting blade, such as the pulleys with their devices for the rotational actuation, the blade tensioning parts by shifting of a pulley-holding spindle, the blade guiding parts, the organs for sensing the position of the cutting edge in order to determine the feeding of the blade as the latter is wearing off, and for sharpening the two blade bevel faces the intersection of which forms the cutting edge, the bench resting on two boxes which are connected to the vertical supporting frameworks of the fixed structure and positioned parallel to the spindles of the driving cylinder of the upper bridge and of the lower abutment cylinder with elements, with the possibility to modify this positioning in accordance with a shifting which is parallel, providing thereby a quick, accurate and controllable adjustment of the spacing between the driving plane and the cutting edge of the blade.

The adjustment of this spacing is thus performed without modifying the relative positions of the blade-guides, of the cutting edge sensing device, of the sharpening devices with respect to the sharpened edge of the cutting blade. Therefore, by means of this structure, the spacing between the edge of the cutting blade and the driving plane can be modified immediately, for the best concerning the slitting conditions, without the need of additional adjustments. The slitting will be the more accurate as this spacing is smaller, it being well understood that beyond a determined value, the penetration of the material into the machine becomes more difficult.

The division of the slitting machine in two distinct assemblies, the one being stationary and carrying the abutment and driving elements for the products, the other one being mobile relative to the first one and carrying the cutting blade and all the elements concerning same, gives moreover the possibility to control the sharpening action. The automatic disengagement of the grinding wheels when the operation is stopped and the automatic re-start thereof against the blade are obtained by the stop pressure cylinder.

As the position of the cutting edge of the blade is immutable with respect to the support thereof, a proximity sensing device mounted on the mobile assembly and positioned opposite to one of the faces of the blade bevel is capable of signalling any abnormal shifting of the cutting line relative to the section of the blade, within the vertical plane. As the ideal slitting conditions correspond in fact to a given position of this cutting line within the thickness of the blade, an action of one sharpening wheel with respect to the other one may bring about the shifting of the cutting edge, the increase in length of one of the faces of the sharpened bevel of the blade, together with a decrease in length of the other face, and this would result in a modification of the working conditions and in a poor quality of the work being done.

In accordance with a further characteristic, an object has been to take into account the fact that in the slitting process of two hides, the hides being cut along the line of the stripe of the back, it is necessary to consider that their thickness is small and that their structure is loose and fibrous on the flanks of such half-hides, while the thickness is more important and the structure is stronger along the strip of the back. In this concept, the mobile assembly mounted on the frame and therefore the blade are adjusted in a "slanted" position, i.e. a position which is inclined relative to the fixed assembly mounted on the boxes which carry more particularly the driving cylinder and the cylinder with elements between which the half-hides are caused to pass. The slanting of the mobile assembly is provided in either direction, according as the bands or half-hides are left-hand (flank side of the hides being on the left when the operator is facing the machine for the introduction of the hides), or right-hand (flank side of the hides being on the right when the operator is facing the machine for the introduction of the hides).

In accordance with a further characteristic, the abutments secured to the frameworks, and which can be actuated for positioning the mobile assembly relative to the fixed assembly, are both equipped with adjustment means for acting independently on either one of the handling devices, with respect to the corresponding fixed abutment, in order to cause the bench and the blade to be slanted angularly according to the half-hides to be slit. The spacing between the cutting edge of the blade and the driving plane between the driving cylinder and the cylinder with elements is reduced thereby in a part of the length in correlation with the reduced thickness of the flanks of the half-hides, while maintaining on the other part of the length the spacing which is necessary for the thicker portions (stripe of the back).

These and other characteristics will be apparent from the following description.

To make the object of the invention better understood, without however restricting it thereby, the invention will be described now with reference to the attached drawings, in which.

Figure 1:
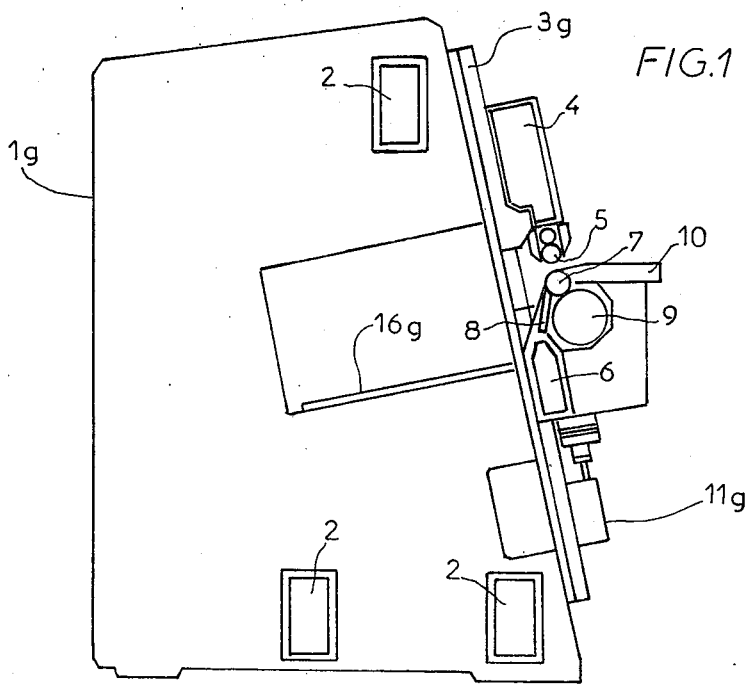
FIG. 1 is a cross-sectional schematic view of the machine in acordance with the invention, in which the fixed assembly only has been illustrated.
Figure 2:
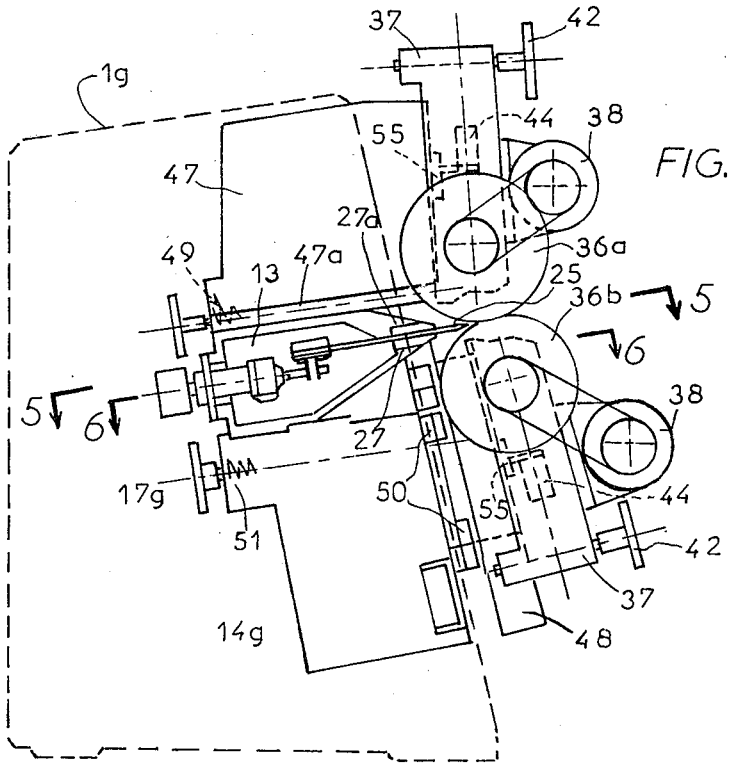
FIG. 2 is a cross-sectional schematic view of the machine in accordance with the invention, in which the mobile assembly only has been illustrated.

To make the object of the invention more concrete, this object will be now described in a non restricting form of embodiment illustrated in the figures of the drawings.

The slitting machine as illustrated schematically includes mainly a fixed assembly and a mobile assembly.

The fixed assembly is comprised of two frameworks (1*g*) and (1*d*) which are maintained parallel by bracing with beams (2). Two guides (3*g*) and (3*d*), flanged on the front faces of the frameworks (1*g*–1*d*), serve as guide means for the upper bridge (4) which carries the driving cylinder (5) according to well-known conventional arrangements, and for the lower abutment (6) which carries the cylinder with elements (7), consisting of independent rings mounted together and which are held in alignment by abutment against a metal guide as explained previously, positioned and guided according to well-known arrangements, comprising guide (8), cylinder with rubber lining (9) and setting table (10), FIG. 1.

The lower abutment (6) is positioned by two adjustable stops (11*d*) and (11*g*) connected to the guides (3*g*) and (3*d*). The upper bridge (4) is positioned by two synchronized and adjustable devices (4*d*) and (4*g*) connected to stops (12*g*) and (12*d*) the control of which is provided by speed reducing gear (12*h*), FIG. 3.

Figure 3:
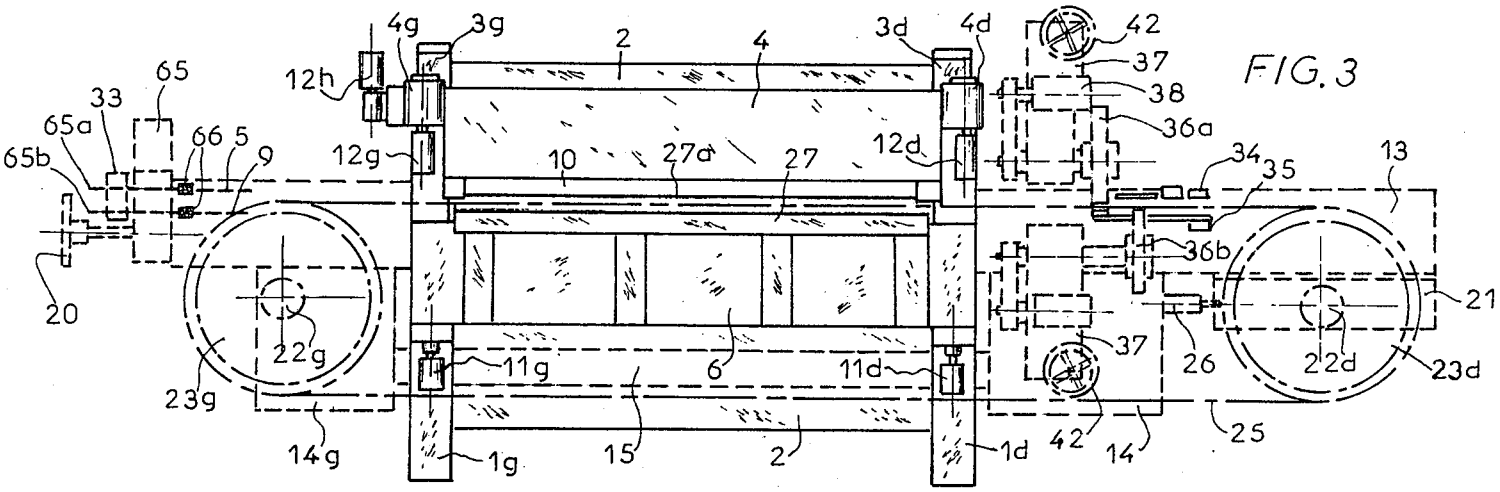
FIG. 3 is a schematic front view of the machine, in which the fixed assembly has been illustrated in solid lines and the mobile assembly has been illustrated in dotted lines.

The driving cylinder (5) and the rubber lined cylinder (9) which drives frictionally the cylinder with elements (7) are driven rotatably for feeding the products into the machine by a speed reducing gear (65) of a well-known type, comprising two transmission shafts (65*a*–65*b*) which are connected to the cylinders (5) and (9) by couplings (66), FIG. 3.

The mobile assembly comprises mainly a longitudinal bench (13) mounted on two boxes (14*g* and 14*d*) which are connected and interbraced by a beam (15) forming thus a rigid and undistortable assembly (FIG. 3).

Figure 6:
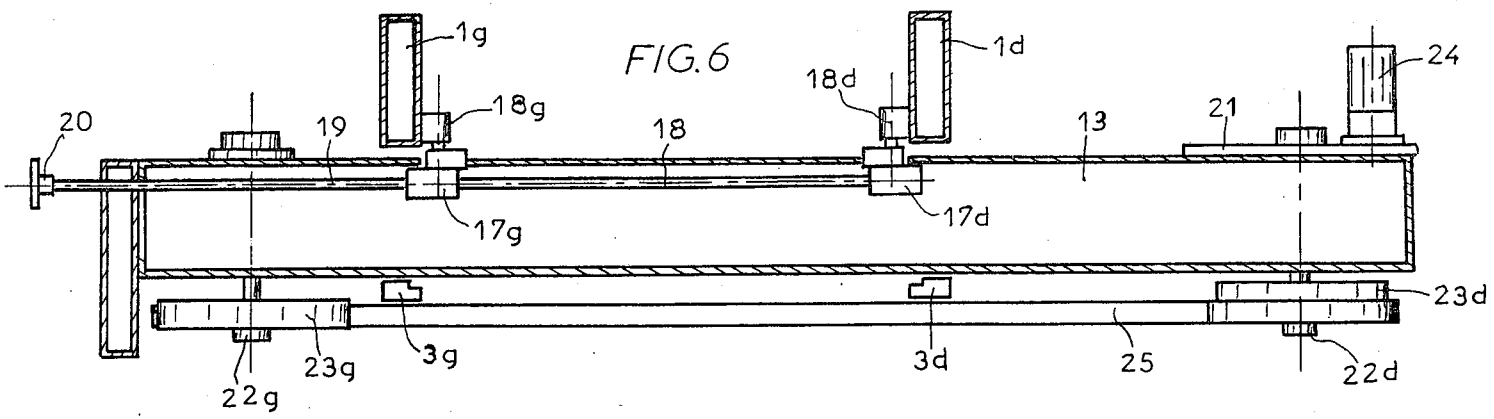
FIG. 6 is a schematic plane and sectional view of the mobile assembly along line 6—6 of FIG. 2, i.e. within the axis of the connection and adjustment devices of the mobile assembly with the fixed assembly.
Figure 7:
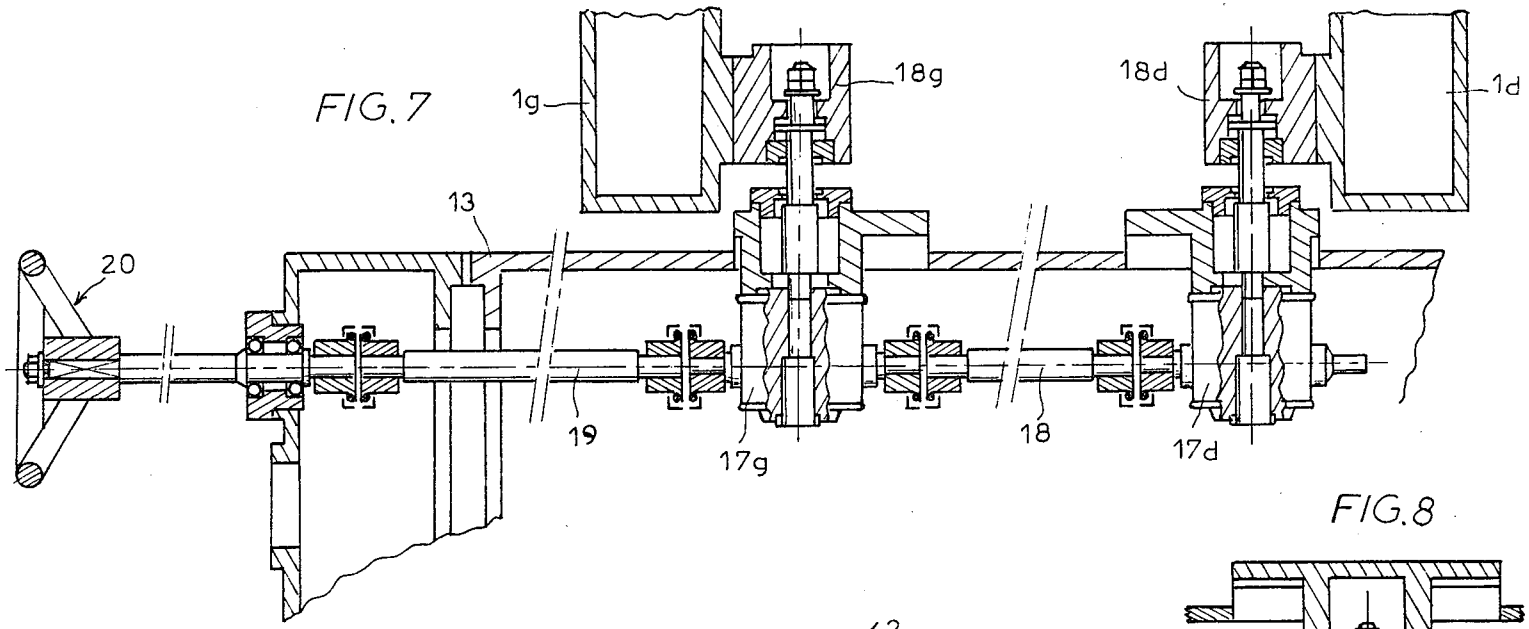
FIG. 7 is a plane and sectional view on a larger scale, illustrating the connection and adjustment devices of the mobile assembly with the fixed assembly.

The frame (13) is resting on the faces (16*d*) and 16*g*) of the two frameworks (1*d*) and (1*g*), FIG. 1, and is positioned with respect to the latter by two adusting devices (17*d*) and (17*g*), of the screw and screw wheel type with nuts and screws, an end of which is immobilized by the abutments (18*d*) and (18*g*) secured to the frameworks (1*d*) and (1*g*). The adjusting devices (17*d*) and (17*g*) are connected in synchronization by a connecting shaft (18) and controlled manually from the inside of the machine, by a shaft (19) equipped with a handling pulley (20). These arrangements are clearly apparent from FIGS. 6 and 7.

Figure 4:
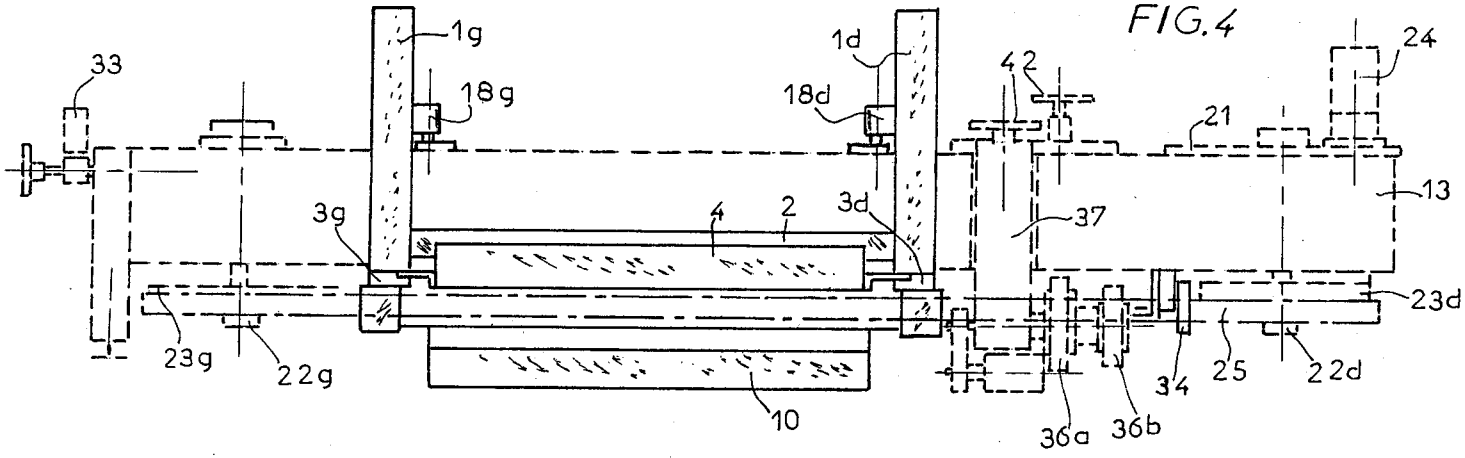
FIG. 4 is a plane view in which the fixed assembly has been illustrated in solid lines and the mobile assembly has been illustrated in dotted lines.

A mobile carriage (21) suspended beneath an end of the frame (13) is supporting a motor shaft (22*d*) which carries a flywheel (23*d*) driven by an internal toothing controlled by an electric motor (24), FIGS. 3 and 4. The box (14*g*) opposite is carrying a shaft (22*g*) equipped with a handwheel (23*g*).

An endless blade (25) is mounted on the two pulleys (23*d*) and (23*g*), and the mobile carriage (21) is stressed by a hydraulic pressure cylinder (26) for tensioning the endless blade (25), FIG. 3.

Figure 5:
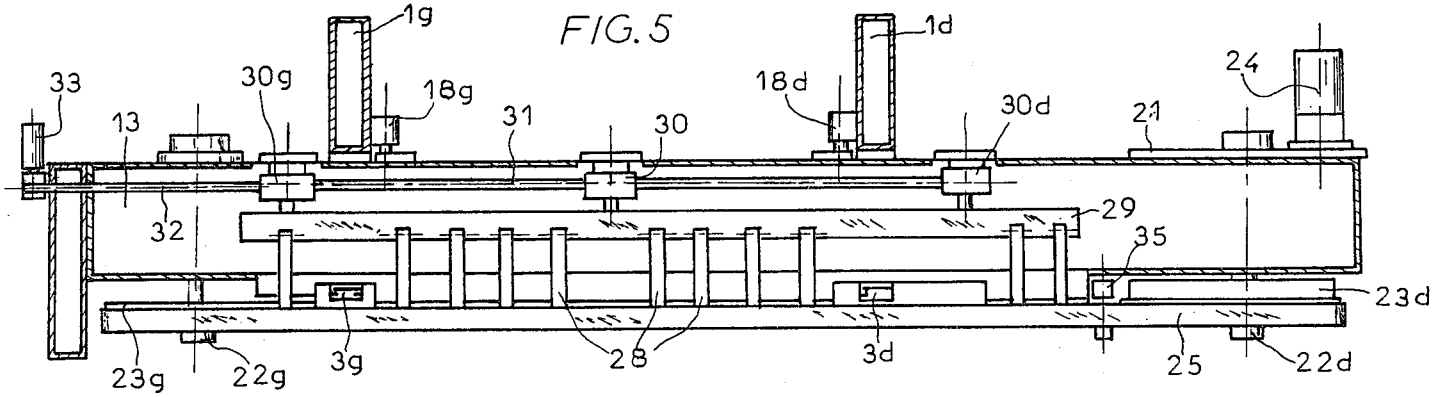
FIG. 5 is a schematic plane and sectional view of the mobile assembly, along line 5—5 of FIG. 2, i.e. within the slitting plane.
Figure 8:
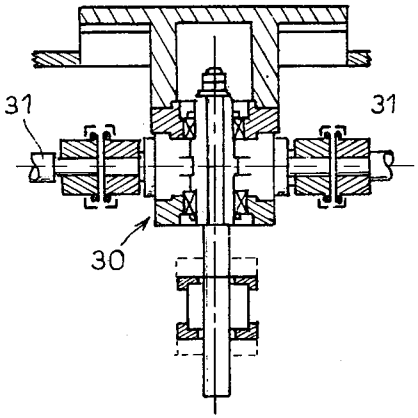
FIG. 8 is a sectional view, on a larger scale, illustrating one of the actuating devices of the upper side of the cutting blade.

The upper side of the blade (25) is guided by two counter-blades (27) and (27*a*) so that the movement of this upper side will take place with a limited operational clearance (FIGS. 2, 3, 14, 15). The heel of the blade (25) is abutting on a series of keys with tips of tungsten carbide (28) connected with a thrust plate (29) which is sliding parallel within the main frame (13) and actuated by three devices (30), (30*d*), (30*g*) of the screw and screw-wheel type with nut and screw (as may be seen in detail, FIG. 8). The devices (30), (30*d*), (30*g*) are interconnected in synchronization by a transmission shaft (31) and they can be actuated from the outside of the machine by a shaft (32) which is rotatably controlled by the speed reducing gear (33), FIG. 5.

The housings of the keys (28) within the thrust plate (29) are made with the high accuracy which is necessary for the faces of tungsten carbide of the keys (28) to be faultlessly aligned for the rectilinear abutment required against the upper side of the endless blade (25).

Figure 14:
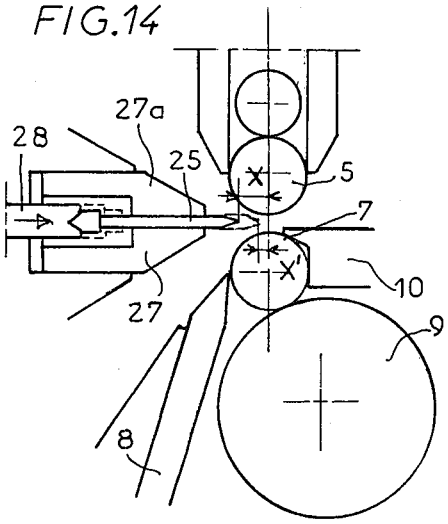
FIG. 14 is a schematic view illustrating the conventional positioning adjustment for the cutting edge, in a given slitting work.

There has been shown in FIG. 14 an example of configuration corresponding to a slitting work for a given workpiece, requiring for a correct result a spacing (X) between the plane of the driving cylinder (5) and of the cylinder with elements (7) and the edge of the cutting blade (25). Based on the position of the blade characterized by the value (X), a value (X') lower than the value (X) is for example necessary with the configuration on conventional machine for different workpieces. This value (X') is obtained by the infeed of the blade (25) determined by the shifting of an electrical positioning photocell and by the forward motion of the blade pushers (28).

By virtue of this infeed of the blade (25) to pass from the distance (X) to the distance (X'), the overhanging of the blade with respect to the guides thereof is increased, whereby the good holding of the blade between the counter-blades (27) and (27*a*) is impaired. Moreover, the sharpening conditions of the blade bevels will be recovered only by the alteration of the positions of both the upper and lower sharpening system.

Figure 15:
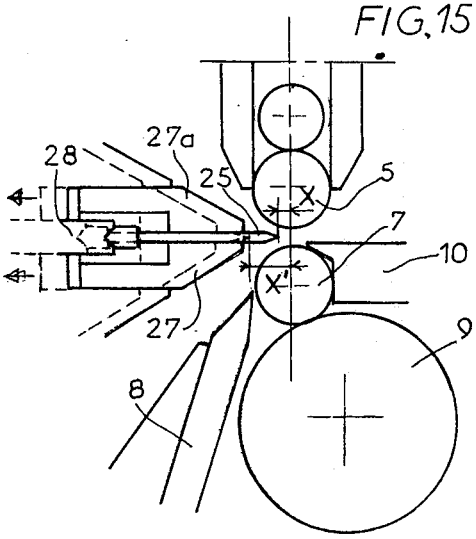
FIG. 15 is a schematic view illustrating the positioning adjustment of the cutting edge, in accordance with the invention.

The adjustment of the position of the blade (25) on the machine in accordance with the invention has been shown in FIG. 15. The passage from the distance (X) to the distance (X') is obtained by the total actuation of the mobile part which carries the blade, relative to the fixed part which supports the driving cylinder (5) and the cylinder with elements (7). The overhanging of the blade (25) out of the guides (27–27*a*) thereof is not modified, and is not necessary to rearrange the grinding wheels, the position of which is in connection with the mobile part. There remains only the compensation adjustment for the wear of the blade, which is performed by means of the keys 28.

Figure 12:
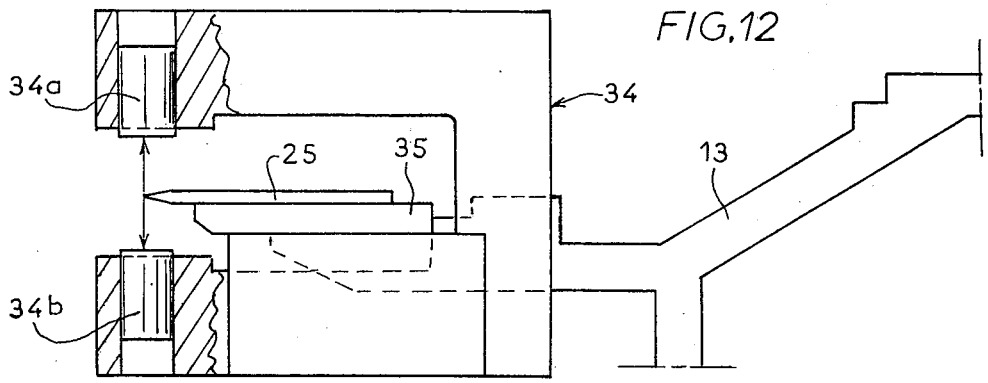
FIG. 12 is a sectional view in part, on a larger scale, illustrating the sensing device for the cutting edge of the blade.

The cutting edge of the blade (FIG. 12) is sensed by an electric photocell sensing device (34) of a well-known type, i.e. comprising a transmitter (34*a*) and a receiver (34*b*). This device mounted on a support (35), which is itself connected with the frame (13), determines the necessary forward motions of the rear heel of the blade (25) pushed by the keys (28), by feeding of the speed reducing gear (33). The immutable position of the cutting edge of the blade (25) with respect to the bench (13) is therefore assured, as the cell only is displaced.

Figure 13:
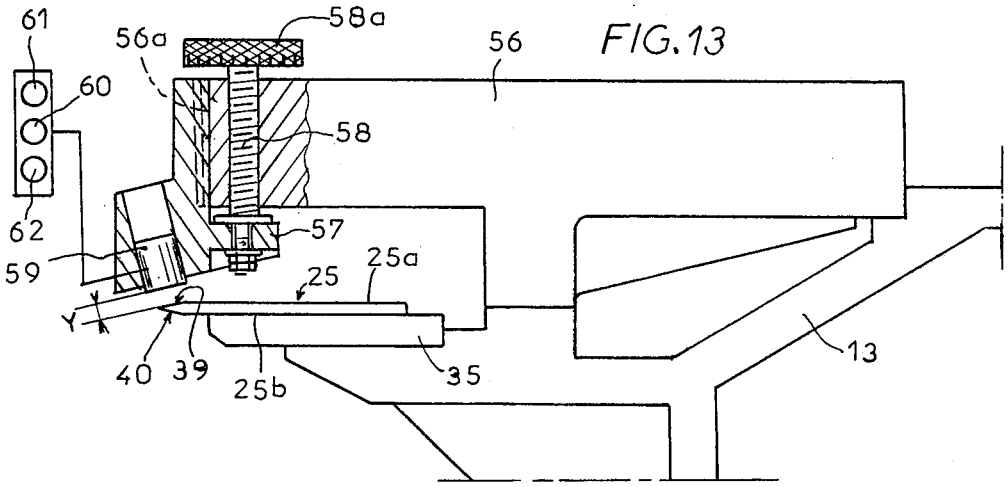
FIG. 13 is a sectional view in part, on a larger scale, illustrating the distance sensing device of the upper bevel of the blade.

Two grinding wheels (36*a*) and (36*b*), mounted on two supports (37) and driven rotatably by the motors (38) with belt transmission (FIG. 2) provide, when they are controlled, for the creation and the maintenance of both the upper bevel (39) and lower bevel (40) of the blade, the cutting edge of the blade being defined by the intersection of these bevels (FIG. 13).

Figure 9:
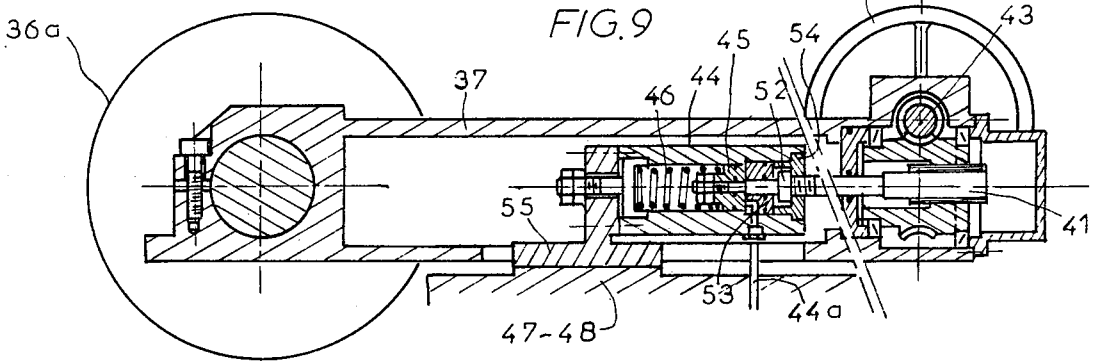
FIG. 9 is a sectional view, on a larger scale, with the rear part turned on 90 degrees, of one of the sharpening devices of the cutting blade.
Figure 10:
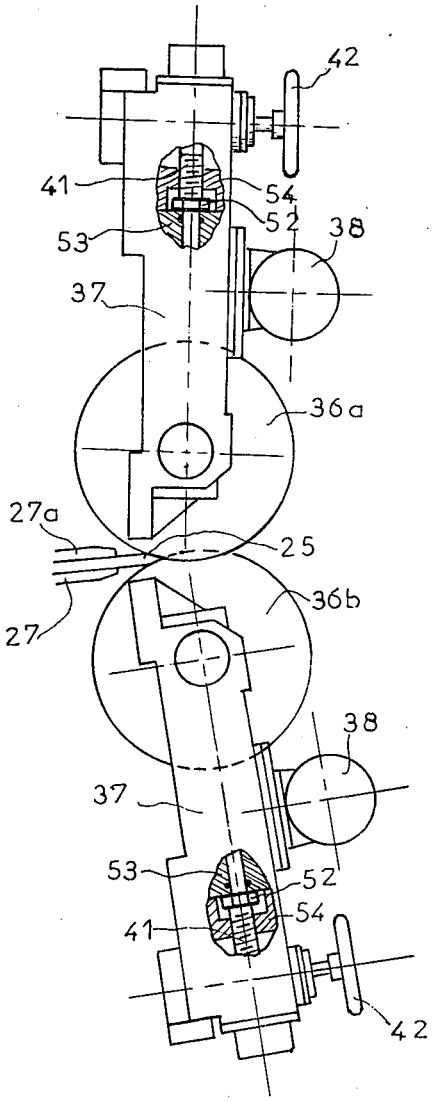
FIGS. 10 and 11 are schematic views illustrating the two sharpening devices, respectively in the working position and in the inactive position.
Figure 11:
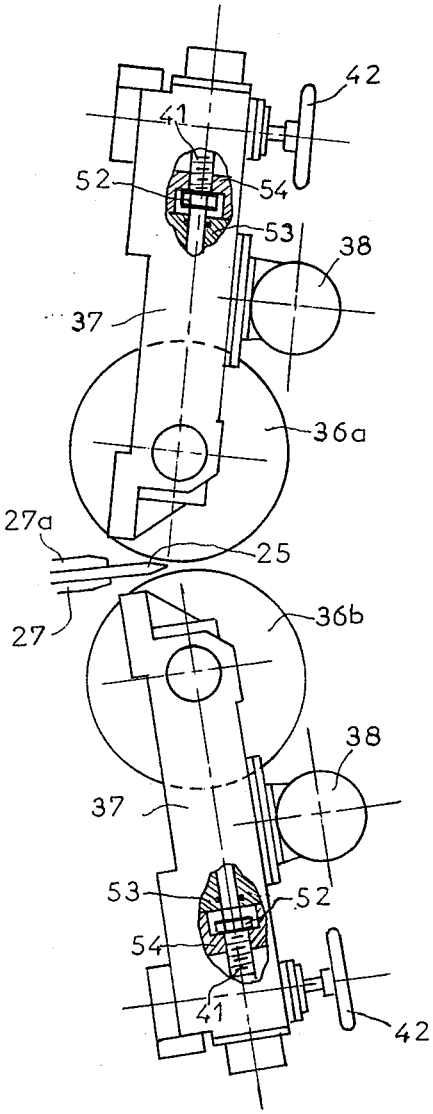

The two supports (37) are of identical design and disposed approximately symmetrically with respect to the blade (25). Each one of these supports can be actuated by a device (41) of the nut and screw type, connected to a handling pulley (42) by a transmission (43) of the low geared screw-wheel and screw type (FIG. 9). An end of the screw of the device (41) is connected with the piston (45) of a single acting hydraulic pressure cylinder (44) with return of the piston (45) by spring (46), (FIG. 9). The hydraulic pressure cylinders (44) of the two supports (37) are flanged to an upper connecting slide (47) and a lower connecting slide (48) by means of squared pieces (55). A power supply (44*a*) through a hydraulic unit (not shown) provides at a given pressure the compression of the springs (46) and the abutment of the two supports (37) within the limits of the displacement permitted to a stop (52) located between a brace tie (53) and a locking nut (54), in the position determined by the adjusting devices (41), FIG. 9. Any interruption of the electric power in the power supply of the hydraulic unit results in a pressure drop of the fluid, and permits the release of the spring (46), with the disengagement of the supports (37) and causing thus the grinding wheels (36*a*) and (36*b*) to be moved away in an inactive position relative to the two bevels of the blade (25), as illustrated in FIG. 11. Conversely, when the hydraulic circuit acting on the piston (45) is under pressure, the spring (46) is compressed and the stop (52) is displaced, causing thus the grinding wheels to be returned to the working position, without the necessity to handle the pulleys (42), as illustrated in FIG. 10.

The upper connecting slide (47) and the lower connecting slide (48) are both mounted adjustable relative to the frame (13). The upper connecting slide (47) is carried by a carriage (47*a*) in abutment adjustable by slideway on the upper face of the frame (13), the adjustment being performed by nut-screw device (49). The lower connecting slide (48) is pivotally mounted on two hinges (50) connected to the front face of the frame (13). The lower connecting slide (48) is pivoted by the actuation of a nut and screw system (51), FIG. 2.

The upper grinding wheel (36*a*) and the lower grinding wheel (36*b*) can thus be positioned independently with respect to the edge of the endless blade, whereby smaller or greater bevel lengths according to the slitting job to be performed can be provided in dependence on the positions which are selected by the adjustment systems (49) and (51).

The division of the slitting machine in accordance with the structure described above permits the distance between the driving plane and the cutting edge of the blade to be varied without modifying in any way:

the holding of the blade (25) in constant overhanging relative to the guiding counter-blades (27) and (27*a*), the position of cutting edge sensing electric photocell relative to the cutting edge, the positions of the two grinding wheels (36*a*) and (36*b*) with respect to the two bevels forming the cutting edge.

Parallel to the location of the device (34) for sensing the cutting edge of the blade (25), and mounted on the frame (13) through the intermediary of the support (35), a device for sensing the distance of upper bevel (39) is flanged to the bench (13), this device being provided to make sure that the cutting edge is maintained in the correct position in the vertical plane.

For this purpose, a support (56) which is bolted to the frame (13) has at one end a slideway (56*a*) connected with a carriage (57) which is vertically adjustable through the operation of a screw (58) with knurled head (58*a*), graduated as the case may be, connected to the carriage and screw threaded into the support (56).

A reflection optoelectronic sensing device (59) opposite of a well-known type is mounted on the carriage (57) opposite the reflective face which is constituted by the upper bevel (39). The reflected portion of light flux is in dependence upon the spacing between the face of reference of the optoelectronic sensing device and the face to be monitored, which is constituted by the upper bevel (39) of the blade (25). For a given distance (Y), the reflected portion or amount of light flux is 50 percent of the emitted flux, and any modification of this distance in either direction results in an increase or a decrease of the reflected flux amount, and translates into voltage of electric current a reading giving three informations by means of indicator lights (60), (61), (62) to the control cabinet. There is for instance:

60—correct position of the bevel,

61—position of the bevel too high,

62—position of the bevel too low.

These informations situate the position of the bevel (39) and in combination with the immutability of position of the cutting edge within the horizontal plane which is monitored by the device (34*b*) they enable the operator of the slitting machine to enhance or to decrease the action of the upper grinding wheel (36*a*) or of the lower grinding wheel (36*b*), ensuring thereby the stability of the position of the cutting edge relative to both the upper face (25*a*) and lower face (25*b*) of the blade (25), FIG. 13. The steadiness of this height of cutting edge makes it possible to maintain permanently an essential component of the slitting conditions as defined for a given work on a given product.

The vertical position of this cutting edge, within the thickness of the blade, and therefore with respect to the two faces thereof, can be modified in either direction, in dependence on the characteristics of the slitting process, the geometrical characteristics or the structural characteristics of the workpiece to be slit.

The acutation of the screw (58) by means of the knurled head (58*a*), causing the carriage (57), which carries the reflection optoelectronic sensing device (59), to be displaced vertically, makes it possible to determine, by the reading of the signalling indicators (60) (61) (62) the action to be taken on one of the grinding wheels relative to the other one, and to obtain the desired position, when the signal "correct position" has been obtained.

Figure 17:
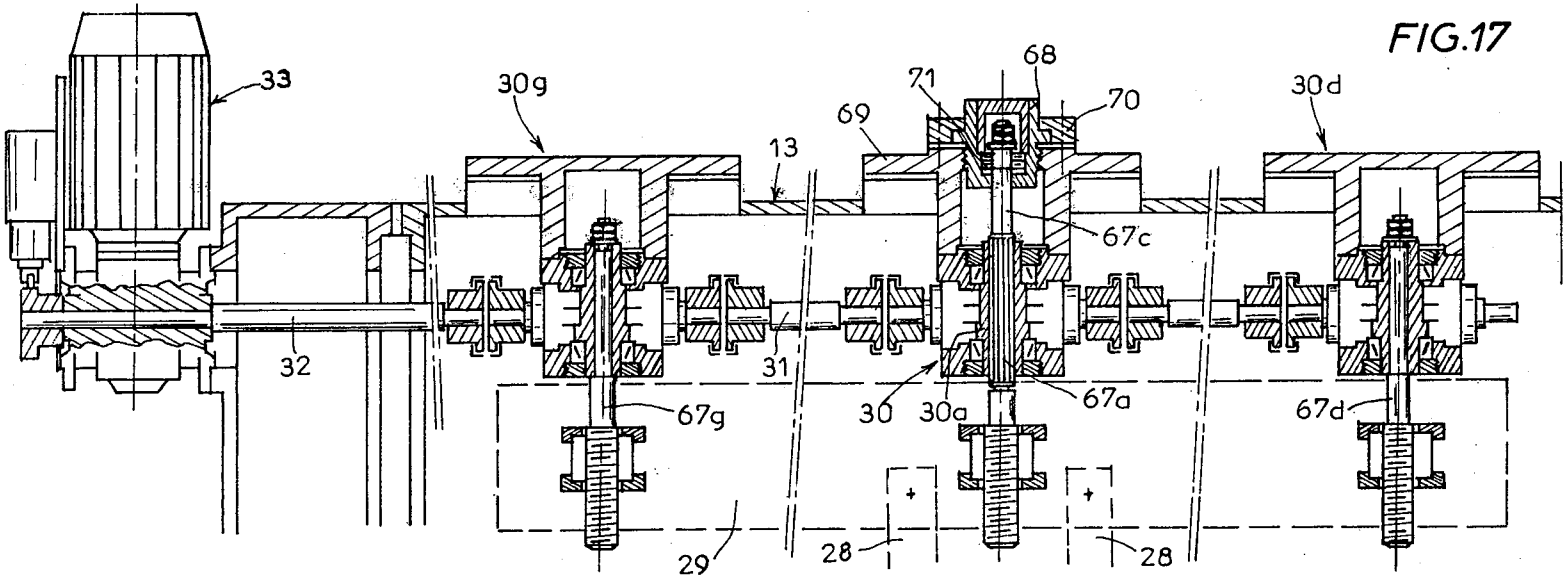
FIG. 17 is a sectional view, on a larger scale, with a breaking off along the length, showing the details of the adjustable mounting of the mobile assembly corresponding to FIG. 16.
Figure 16:
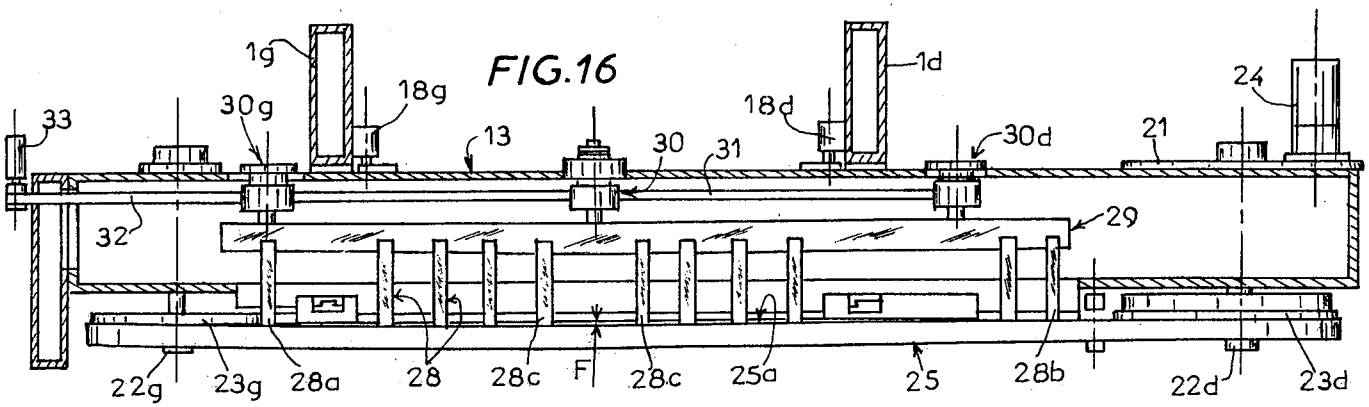
FIG. 16 is a schematic plane and sectional view of the mobile assembly, showing more particularly the arrow (F) taken by the cutting blade.
Figure 20:
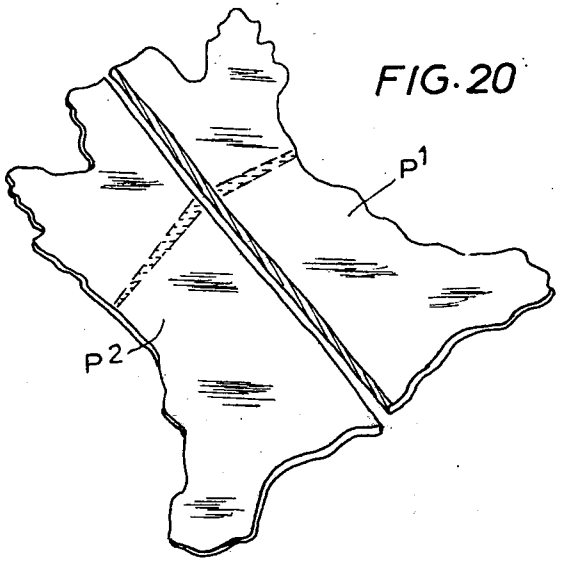
FIG. 20 is a perspective view illustrating two half-hides.
Figure 19:
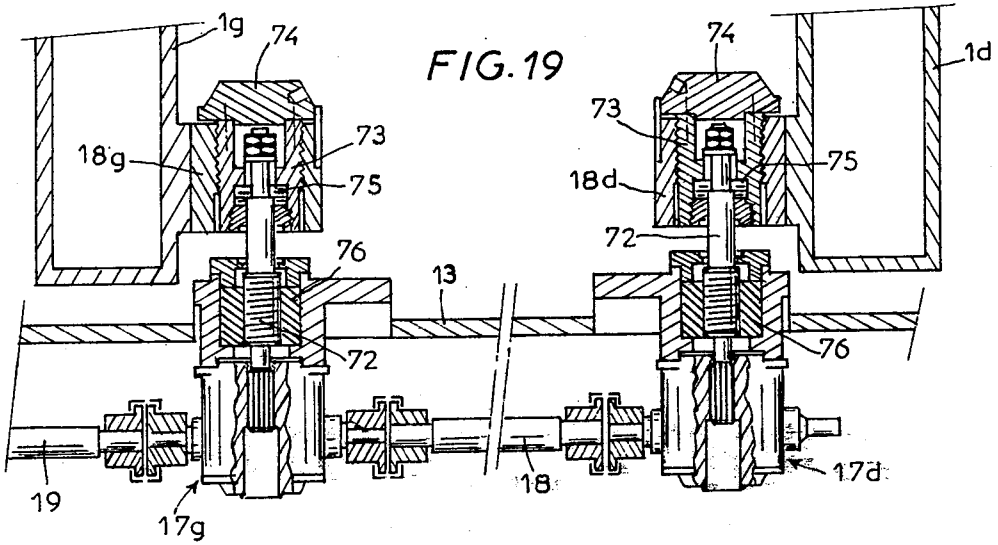
FIG. 19 is a sectional view in part, on a larger scale and with breaking off along the length, showing the details of the adjustment means for the "slanting" of the mobile assembly.
Figure 18:
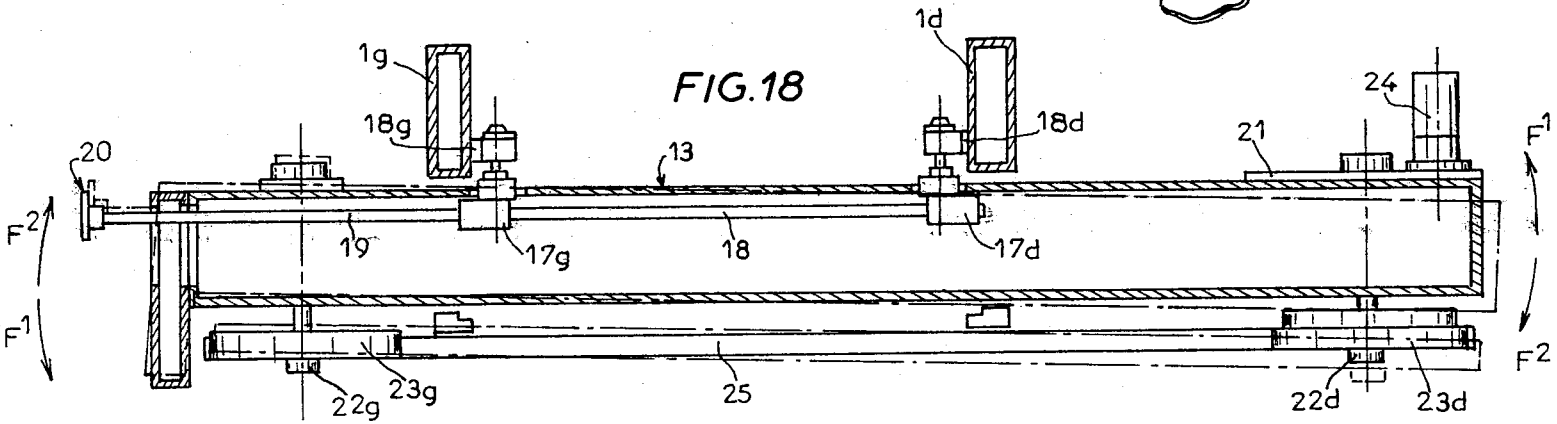
FIG. 18 is a schematic view of a cross-sectional view of the mobile assembly, considered within the axis of the connection and adjustment devices with respect to the fixed assembly; one of the possible shiftings of said mobile assembly, corresponding to the "slanting", has been shown in dotted lines.

According to FIGS. 16 and 17, the lateral devices (30*d*) (30*g*) are provided with feed control screws (67*d*)

and (67*g*) respectively, mounted fixedly relative to said devices, while the central screw (67*c*) is mounted adjustable relative to the device (30) in order to distort by being driven in the central portion of the plate (29) for obtaining a forward motion of the central keys or pushers (28*c*) so as to compensate the distortion of the blade (25) at this place.

For this purpose, the central screw (67*c*) has a grooved or channeled central portion (67*a*) cooperating with a grooved or channeled sleeve (30*a*) of the device (30) and the fulcrum of the screw (67*c*) is constituted by a screw threaded socket (68) forming by itself a handling screw together with a support with screw threaded bore (69) secured on the bench (13) within the central axis.

The screw threaded socket (68) is provided with reference marks or graduations for the valuation of the shifting performed by the rotational motion of this socket, and necessary for obtaining the contact of the pushers (28*c*) with the heel (25*a*) of the blade (25).

An immobilizing washer (70) connected to the support (69) is abutted on a collar of the socket to prevent any undesired rotation and the misadjustment of the screw threaded socket (68), a ball stop or similar means (71) being interposed between socket (68) and screw (67*c*).

As indicated, the frame (13) is positioned relative to the frameworks (1*d*) (1*g*) by two adjusting devices (17*d*, 17*g*) of the screw and screw wheel type with nuts and screws, connected in synchronization by a connecting shaft (18) and controlled manually from the outside of the machine, by a shaft (19) provided with a handling wheel (20).

The screws (72) of the adjusting devices (17*d*, 17*g*) are connected to the abutments (18*d*, 18*g*) integral with the frameworks (1*d*, 1*g*).

For the accurate positioning of the mobile assembly with respect to the fixed assembly, in dependence on the characteristics of the half-hides (P1–P2) which are presented, there has been provided an adjustment of the position by the screws (72) cooperating with the nuts (76) of the devices (17*d*, 17*g*). The upper end of said screws is connected by ball stops (75) or equivalent means to screw threaded sockets (73) engaged within the screw threaded bore of the abutments (18*d*, 18*g*). Graduated collars (74), made fast with the sockets (73), are provided with operating means so that by rotation of the socket-collar assembly the adjusting devices (17*d*, 17*g*) may be displaced in one direction (F1) or in the other direction (F2), and independently, with respect to the abutments (18*d*, 18*g*).

This action makes it possible to decrease the spacing between the cutting edge of the blade (25) and the driving plane between the driving cylinder and the cylinder with elements, for a part of the length corresponding with the reduced thickness of the flanks of the half-hides, while in the other part of the length, the necessary spacing is preserved with respect to the thicker portions of the half-hide (stripe of the back).

In accordance with this arrangement, the following will be underlined: the very accurate immutable position of the cutting edge within the horizontal plane relative to the mobile part, the fact that the blade is resting substantially on all the pushers, whereby the central deflection and the distortions of the blade are prevented, and the adjustment of the spacing between the cutting edge and the driving plane, in dependence on the characteristics of the half-hides.

We claim:

1. Slitting machine, more particularly for hides and leather, unwoven textile products, rubber materials, plastics in plates, comprising a framework, a working table for presenting the materials or products to the slitting process, a driving device for said products or materials by means of two cylinders mounted in front of an endless cutting blade the upper and the driving of said cylinders being placed above and the lower cylinder, being a cylinder with elements, beneath the plane of the tensioned side of said endless cutting blade supported by two pulleys, at least one of which is motive and tensioning, the spacing between said cylinders being adjustable, a sharpening system constituted by two grinding wheels each one of which is acting on one of the two bevelled faces forming at the intersection thereof the cutting edge of said blade, said machine being characterized in that the bearing structure thereof is designed to divide parts of said machine in two distinct assemblies, namely: a fixed assembly carrying means for presenting, positioning and driving the products, disposed on either side of the cutting line and adjustable distinctly and separately with respect to this cutting line constituted by the cutting edge of the tensioned upper side of said endless blade; and an assembly which is mobile within the horizontal plane relative to the fixed assembly and includes a frame for the support of said blade, provided with means for guiding, positioning, driving and sharpening, said blade, the cutting edge of which is formed at the intersection of two sharpened bevelled faces and has an immutable position within the horizontal plane relative to said frame; said mobile assembly being movable relative to said fixed assembly of the structure to modify the spacing between the driving plane which is the imaginary plane passing through the axes of said upper driving cylinder and of said lower cylinder with elements supported by said blade positioned in an immutable manner within the horizontal plane relative to said mobile assembly.

2. Slitting machine as claimed in claim 1 characterized in that said fixed assembly resting on the ground has two vertical frameworks which are braced by beams to ensure parallelism, rigidity and stability, said frameworks supporting two parallel guides on which are placed an upper bridge and a lower abutment for the presentation of the materials or products in front of the cutting blade and the driving of same at the desired speed; a lower abutment which carries said lower cylinder with elements including means necessary for positioning said cylinder, with elements for guiding holding and retaining said cylinder with elements by means of a cylinder with rubber lining of predetermined hardening; said upper bridge said upper driving cylinder including means necessary for positioning said upper driving cylinder, for guiding and holding same; said upper bridge and said lower abutment being positioned respectively above and beneath the tensioned upper side of said upper bridge, in dependence on the characteristics of the slitting work to be made, this being obtained by actuating and positioning means connected to the guides and to stops controlled by a speed reducing gear, these means being integral with the frameworks.

3. Slitting machine as claimed in claim 1, characterized in that the mobile assembly the position of which can be adjusted has mounted on a longitudinal frame means for supporting and driving said cutting blade such as pulleys with driving means, means for tensioning said blade by displacing a carriage relative to, said frame means for guiding said blade, means for sensing the position of the cutting edge, and means which carry grinding wheels for sharpening said two bevelled faces of said blade; said frame resting on two boxes which are interconnected and interbraced by a beam to form a rigid and undistortable assembly by virtue of the connection thereof with the frameworks; said frame being positioned parallel to the axes of said upper driving cylinder of said upper bridge and of said lower cylinder with elements, in an adjustable manner, ensuring thereby a quick, accurate and controllable adjustment of the distance between the driving plane and the cutting edge of the blade.

4. Slitting machine as claimed in claim 1, characterized in that the mobile assembly is positioned relative to the fixed assembly by two adjusting devices of the screw and screw-wheel type, an end of which is immobilized by abutments secured to the frameworks connected to a adjusting means disposed outwardly of the machine.

5. Slitting machine as claimed in claim 1, characterized in that the adjustment of the distance between the plane passing through said cylinders and the cutting edge of said blade is performed after sensing by, optical means by total actuation of the mobile assembly carrying the blade with respect to the fixed part supporting said driving cylinders, whereby the overhanging of the blade out of it's guides thereof is kept constant.

6. Slitting machine as claimed in claim 5, characterized in that said optical means for sensing the cutting edge of said blade is of the electric photocell type with transmitter and receiver, mounted fixedly on a frame; as said blade is wearing off by reason of the sharpening performed on said two bevels of the blade, information is given by the cutting edge sensing device, whereby a speed reducing gear is caused to be actuated and to shift by synchronized operation of three devices interconnected by a shaft and connected to said speed reducing gear by a shaft, a pushing plate, provided with keys for the heel of the blade, which are arranged and secured accurately so that they will be substantially aligned.

7. Slitting machine as claimed in claim 3, characterized in that said grinding wheels are mounted on identical supports disposed approximately symmetrically relative to the upper side of said blade and flanged at on an upper connecting slide and a lower connecting slide; said upper connecting slide being supported by a carriage sliding on said frame and actuated by nut-screw device, while the connecting slide is mounted pivotally by means of two hinges on the front face of said frame and is actuated by nut-screw device.

8. Slitting machine as claimed in claim 7, characterized in that the connection points of said grinding wheels with the respective connecting slide thereof support a single acting hydraulic pressure cylinder of which a piston with return spring is connected to an operating means through a low geared transmission, said hydraulic cylinder, when under pressure, causing the compression of said spring and the shifting of a stop secured on a means between two parts of the pressure cylinder in a direction where said grinding wheels are away from said blade while conversely, when said hydraulic cylinder is in depression, said spring is released and said stop is shifted in the opposite direction where said grinding wheels are in contact with the bevelled faces of said blade, all this without the necessity to operate the adjusting means.

9. Slitting machine as claimed in claim 8, characterized in that the mobile assembly has a position sensing device of the upper bevel of said blade of the reflection optoelectronic sensor type mounted opposite said bevel on a carriage connected to a support integral with said frame; any modification of the light flux percentage reflected by the bevel being translated into voltage of electric current onto indicator lights indicating the position of the bevel, namely: correct position, position too high, position too low, this information in combination with the immutability of the position of the cutting edge within the horizontal plane, enabling the operator to enhance or to decrease the action of said grinding wheels for ensuring the stability of the position of the cutting edge with respect to the faces of said blade.

10. Slitting machine is claimed in claim 9, characterized in that said reflection optoelectronic device is mounted vertically adjustable through connection of the carriage and of a support by means of a slideway and of a screw connected with the carriage and screw threaded within the support; the actuation of the screw by means of a gripping head thereof, which is graduated as the case may be, causing a shifting of said carriage, and permitting to determine by reading of the indicator lights the action to be taken with one of said grinding wheels relative to the other one, and to obtain the desired position.

11. Slitting machine as claimed in claim 6, with a mobile assembly having said frame provided with three means for connection with a thrust plate of said cutting blade through the intermediary of keys, characterized in that the central means acting against the thrust plate has adjustment means for distorting, by pushing it, the central portion of the thrust plate, so that the central pushers or keys will be moved forward to abut against the heel of said blade compensating thereby the distortion thereof.

12. Slitting machine as claimed in claim 11, characterized in that the adjustment means for the distortion of the thrust plate consist of a screw threaded socket forming itself an actuation screw together with a support with screw threaded bore secured on said frame and connected to a feed control central screw, comprising a grooved or channeled central portion cooperating with a grooved or channeled sheath.

13. Slitting machine as claimed in claim 12, characterized in that an immobilization washer is provided and connected to said support while abutting on a collar of said socket in order to prevent the undesired rotation and the misadjustment of said screw threaded socket.

14. Slitting machine as claimed in claim 4, with a mobile assembly positioned relative to a fixed assembly by means of two adjusting devices of the screw and screw-wheel type, connected to abutments secured to frameworks, characterized in that the abutments are both provided with adjustment means making it possible to actuate independently either one of the adjusting devices relative to the corresponding fixed abutment in order to incline angularly the frame and said blade according to the hides to be slit and therefore to reduce in a part of its length the gap between the cutting edge of said blade and the driving plane of the hides between said driving cylinder and said cylinder with elements, in accordance with the reduced thickness of the flanks of the hides, while maintaining on the other part of the length the gap which is necessary with respect to the thicker portions of the hides.

15. Slitting machine as claimed in claim 14, characterized in that the adjustment means of the devices consist of screw threaded sockets with actuation head engaged within the screw threaded bore of the abutments, said sockets being connected to the devices by screws cooperating with nuts.

16. Slitting machine as claimed in claim 13, characterized in that said screw threaded sockets are connected to the screws through the intermediary of ball stops or similar means.

17. Slitting machine as claimed in claim 15, characterized in that the screw threaded sockets are provided with reference marks or graduations making it possible to valuate with accuracy the shifting which has been performed.

* * * * *